United States Patent [19]

Hironaka et al.

[11] Patent Number: 4,953,526

[45] Date of Patent: Sep. 4, 1990

[54] PORTABLE WORK MACHINE

[75] Inventors: Yoshiaki Hironaka, Sayama; Tatsuhiko Matsubayashi; Yoshikiyo Kamata, both of Hachioji; Takanobu Tasaki, Tokyo, all of Japan

[73] Assignee: Kioritz Corporation, Tokyo, Japan

[21] Appl. No.: 405,166

[22] Filed: Sep. 11, 1989

[30] Foreign Application Priority Data

Oct. 5, 1988 [JP] Japan ..... 63-130017[U]

[51] Int. Cl.[5] ..... F02N 17/08

[52] U.S. Cl. ..... 123/182; 123/195 C

[58] Field of Search ..... 123/182, 195 C, 198 E

[56] References Cited

U.S. PATENT DOCUMENTS

| | | | |
|---|---|---|---|
| Re. 27,410 | 6/1972 | Anderson et al. | 123/182 |
| 3,538,899 | 11/1970 | Burkett | 123/182 |
| 3,774,303 | 11/1973 | Burkett et al. | 123/182 |
| 4,773,365 | 9/1988 | Nagashima | 123/195 C |

*Primary Examiner*—Andrew M. Dolinar

*Attorney, Agent, or Firm*—Browdy and Neimark

[57] ABSTRACT

A portable work machine equipped with an internal combustion engine. A starting pressure reducing device is mounted on a cylinder of the engine for reducing, at starting of the engine, pressure within a combustion chamber defined in the cylinder. A hole is formed at a portion of an engine cover which is within reach of a finger of a hand holding a handle, and is closed by a flexible cap. An actuating portion of the starting pressure reducing device is disposed inside the cap.

1 Claim, 1 Drawing Sheet

PORTABLE WORK MACHINE

BACKGROUND OF THE INVENTION

The present invention relates to a portable work machine having an internal combustion engine as its power source.

A portable work machine such as a chain saw or an engine-powered cutter is usually equipped with an air-cooled two-cycle internal combustion engine as its power source. In general, the internal combustion engine is started by a manual starter such as a recoil-type starter. During the starting of the engine, however, because of resistance encountered by the piston during its compression stroke, the starter cannot be smoothly operated manually. This leads to various disadvantages. In particular, the starting of a high-output engine is difficult; in addition, a great shock may act upon the hand or arm of the operator, thereby putting the operator in danger.

SUMMARY OF THE INVENTION

The present invention has therefore been made in order eliminate such disadvantages of the prior art. It is an object of the present invention to provide a portable work machine of which the internal combustion engine is provided with a starting pressure reducing device, and which facilitates the starting of the engine by the operator while the operator, who is in the condition and posture that he normally assumes during an engine-starting action, operates the starter and the starting pressure reducing device simultaneously.

According to the present invention, there is provided a portable work machine comprising: an internal combustion engine disposed in the machine main body; a cover surrounding the engine; a handle capable of being manually held by the operator; a manual starter for starting the engine; a starting pressure reducing device mounted on the cylinder of the engine for reducing, at the starting of the engine, the pressure within the combustion chamber defined in the cylinder; a hole formed at a portion of the cover which is within the reach of a finger of the operator's hand holding the handle; and a flexible cap closing the hole, the actuating portion of the starting pressure reducing device being disposed inside the cap.

With the above-specified arrangement, therefore, during the starting of the internal combustion engine, the operator holds the handle in such a manner that the operator's hand firmly holds the machine main body in a stable position. When a finger of this hand actuates the actuating portion of the starting pressure reducing device through the flexible cap, thereby reducing the pressure within the combustion chamber in the cylinder of the engine, while the operator's other hand operates the manual starter, the engine can be started easily. The cap also provides other functions such as waterproofing and heat insulation.

By virtue of the above-described arrangement, the portable work machine of the present invention enables the engine to be started easily and safely, without requiring any excessive operation from the operator, and with a simple structure which seldom suffers from failure.

BRIEF DESCRIPTION OF THE DRAWINGS

The single FIGURE is a partially sectioned view of a chain saw to which the arrangement of the present invention is applied, the left side from the center of the machine body being shown in vertical section.

PREFERRED EMBODIMENT OF THE INVENTION

Figure 1:
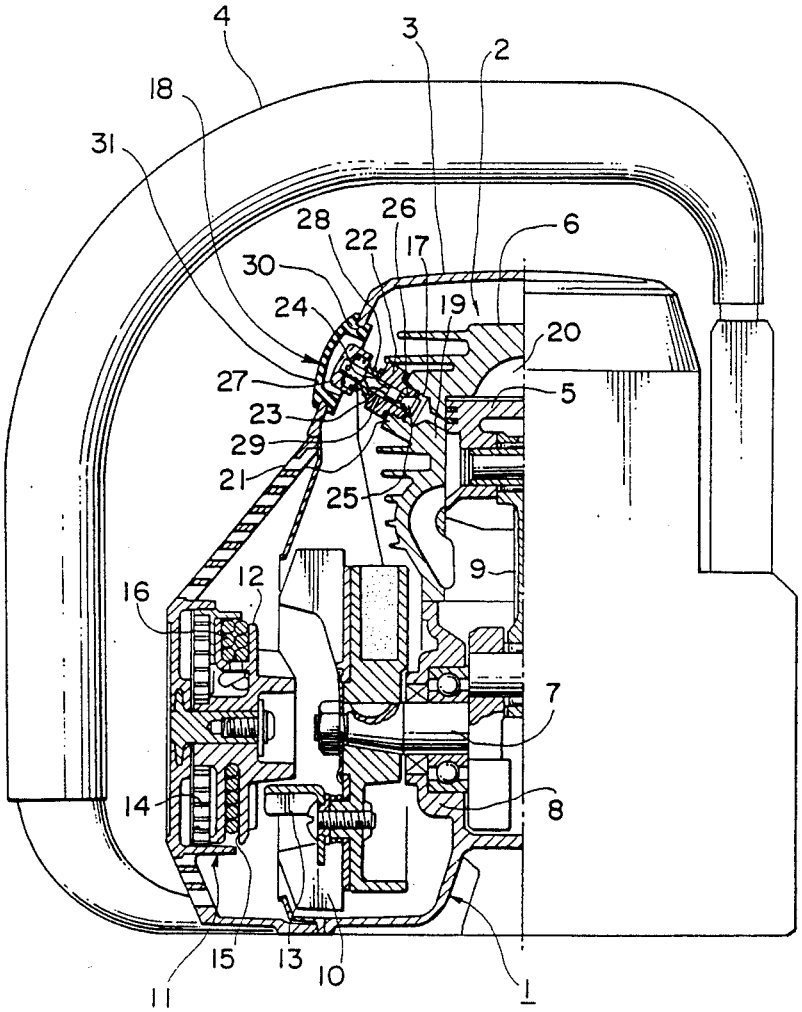

The present invention will now be described with respect to the illustrated embodiment thereof.

The illustrated embodiment is the application of the present invention to a chain saw. The main body 1 of the chain saw, embodying the portable work machine, includes an internal combustion engine 2 disposed therein as the power source. The machine main body 1 also includes a cover 3 mounted in such a manner as to surround the internal combustion engine 2. Furthermore, a left-hand handle 4, which is a handle capable of being grasped by the left hand of the operator, is mounted on the main body 1 in such a manner as to extend around the outside of the upper portion and a side portion of the cover 3.

Although not shown, a right-hand handle provided with a throttle trigger is disposed on a rear end portion (also not shown) of the main body 1.

In this embodiment, the internal combustion engine 2 is of the air-cooled two-cycle type, and has a cylinder 6 reciprocatively receiving a piston 5, and a crankcase 8 provided below the cylinder 6 and rotatably supporting a crankshaft 7, the piston 5 and the crankshaft 7 being connected via a connecting rod 9. A cooling fan 10 is mounted on that end of the crankshaft 7 which projects from the crankcase 8. Also disposed inside the cover 3 is a manual starter 11 which is coaxial with the crankshaft 7.

The manual starter 11 is a recoil-type starter in common use. The starter 11 has a rotary drum 12 which is connected, via a centrifugal ratchet 13 provided on the cooling fan 10, to the cooling fan 10, hence, to the crankshaft 7. The rotary drum 12 is also connected to a recoil spring 14 disposed on the other side of the drum 12. The rotary drum 12 has a peripheral groove 15 on which a recoil rope 16 is wound, with the inner end of the rope 16 fixed to the drum 12. The recoil rope 16 has its outer end portion (not shown) disposed outside the cover 3 in such a manner as to project upwardly, the outer end of the rope 16 being provided with a grip (not shown) directed to the rear of the main body 1. During the starting of the engine 2, when the grip at the outer end of the recoil rope 16 is pulled by the right hand of the operator, the rope 16 being pulled causes the rotation of the rotary drum 12. The force of this rotation is transmitted via the centrifugal ratchet 13 to the crankshaft 7, and the rotation of the crankshaft 7 causes the engine 2 to start. When the grip connected to the rope 16 is released from the operator's hand, the rotary drum 12 utilizes the spring force accumulated by the recoil spring 14 during the pulling of the rope 16, whereby the drum 12 undergoes reverse rotation to allow the rope 16 to automatically recoil on the peripheral groove 15.

According to the present invention, the wall of the cylinder 6 of the internal combustion engine 2, which defines a combustion chamber 20 in cooperation with the piston 5, has, at its left upper portion (as viewed in the FIGURE), a through hole 17 obliquely extending to open to the outside. A starting pressure reducing device 18 is mounted in the through hole 17. The inner end portion 19 of the hole 17 has a small diameter and opens into the combustion chamber 20 in the cylinder 6 and at a position which is below the top-dead-center of the piston 5 and which avoids any inconvenience to the idling of the engine 2. The outer end portion 21 of the hole 17 has a large diameter and opens to the outside at a position which is located obliquely upward from the inner end portion 19 and which facilitates the operation of an outer end portion of the starting pressure reducing device 18 by the operator. The outer end portion 21 has an internal thread cut in the inner periphery thereof.

On the other hand, the starting pressure reducing device 18 has, on the whole, a poppet-valve like structure. A valve body 22 of the device 18 is threaded from the outside in the outer end portion 21 of the through hole 17 of the cylinder 6. The valve body 22 has a passage hole 23 formed therein and extending longitudinally and axially through the valve body 22. A plunger 24 is reciprocatively received in the passage hole 23. The inner end portion of the plunger 24 is provided with a valve portion 25 integral therewith. The valve portion 25 is capable of being seated on a valve seat 26 formed at the inner end portion of the valve body 22, in which condition, the combustion chamber 20 in the cylinder 6 is tightly closed. The outer end portion of the plunger 24 which projects outwardly from the valve body 22 is provided with a push-button shaped actuating portion 27. A compression spring 28 is disposed between the actuating portion 27 and the outer end portion of the valve body 22. The compression spring 28 acts to urge the actuating portion 27 obliquely upward, and also acts to keep the valve portion 25 in close contact with the valve seat 26 in normal condition. The valve body 22 is also formed with a downwardly directed transverse hole 29 at a position close to the outer end portion of the valve body 22, transverse hole 29 allowing the communication therethrough of the passage hole 23 with the outside.

The cover 3 has a hole 30 formed in an upper side portion thereof which is positioned directly under the left-hand handle 4. The portion of the cover 3 where the hole 30 is formed is so provided as to be within the reach of the thumb of the left hand of the operator as the left hand is simultaneously holding the left-hand handle 4. A cap 31 formed of a flexible material such as rubber is fitted on and tightly closes the hole 30. The cap 31 also serves to prevent the penetration of rain drops, etc., to the inside of the cover 3, the insulate the heat from the cylinder 6, and to prevent the leakage of cooling air. The actuating portion 27 of the starting pressure reducing device 18 is disposed inside the cap 31, so that, when necessary, the operator is able to depress, with the thumb of his left hand, the actuating portion 27 through the cap 31 and against the force of the spring 28.

In order to start the internal combustion engine 2, while the operator holds the left-hand handle 4 with the left hand, the operator uses the thumb of the left hand to depress the actuating portion 27 of the starting pressure reducing device 18 through the cap 31. This depression of the actuating portion 27 causes the valve portion 25 of the plunger 24 to be separated from the value seat 26. With this separation, the combustion chamber 20 in the cylinder 6 opens to the outside air through the passage hole 23 and the transverse hole 29. Thus, the pressure within the combustion chamber 20 is reduced, thereby attaining a reduction in the resistance which the piston 5 receives during its compression stroke. With this condition, when the operator pulls, with his right hand, the grip at the outer end of the recoil rope 16 of the starter 11, the rotary drum 12 is caused to rotate. Thus, the engine is started with ease.

What is claimed is:

1. A portable work machine comprising: an internal combustion engine disposed in the machine main body; a cover surrounding said engine; a handle capable of being manually held by the operator; a manual starter for starting said engine; a starting pressure reducing device mounted on a cylinder of said engine for reducing, at starting of said engine, pressure within a combustion chamber defined in the cylinder; a hole formed at a portion of said cover which is within reach of a finger of a hand holding said handle; and a flexible cap closing said hole, an actuating portion of said starting pressure reducing device being disposed inside said cap.

* * * * *